US007494385B2

(12) United States Patent
Copper et al.

(10) Patent No.: US 7,494,385 B2
(45) Date of Patent: Feb. 24, 2009

(54) ELECTRICAL CONNECTOR WITH A WEDGE AND LUBRICANT

(75) Inventors: Charles Dudley Copper, Hummelstown, PA (US); Barry Johnson, Vaughan (CA); Dmitry Ladin, Maple (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/804,066

(22) Filed: May 16, 2007

(65) Prior Publication Data

US 2008/0287010 A1 Nov. 20, 2008

(51) Int. Cl.
*H01R 4/50* (2006.01)

(52) U.S. Cl. ..... 439/770

(58) Field of Classification Search ..... 439/761–764, 439/770, 772, 774, 781, 783, 402, 411, 431; 174/94 R See application file for complete search history.

(56) References Cited

U.S. PATENT DOCUMENTS 2,533,763 A * 12/1950 Cacciotti ..... 439/764
3,156,763 A * 11/1964 Zelley ..... 174/94 R
3,235,944 A 2/1966 Broske et al.
4,247,159 A 1/1981 Fruchard
4,279,461 A 7/1981 Bussen et al.
4,471,159 A 9/1984 Frank, Jr.
4,650,273 A 3/1987 Roosdrop
4,684,196 A 8/1987 Smith et al.
4,723,921 A 2/1988 Pooley
4,764,131 A 8/1988 Beinhaur
4,915,653 A 4/1990 Mair
4,938,706 A * 7/1990 Sykes ..... 439/202
5,090,923 A 2/1992 Kenyon et al.
5,092,797 A 3/1992 Cole et al.
5,244,422 A * 9/1993 Laricchia ..... 439/783
5,342,224 A 8/1994 Lefavour
5,692,930 A 12/1997 Garver et al.
5,704,816 A 1/1998 Polidori
5,752,860 A 5/1998 Greaves
6,004,165 A 12/1999 Dinh et al.

(Continued)

FOREIGN PATENT DOCUMENTS

WO WO 97/01873 1/1997

OTHER PUBLICATIONS

International Search Report, International Application No. PCT / US2008 / 006215, International Filing Date May 15, 2008.

*Primary Examiner*—Chandrika Prasad

(57) ABSTRACT

An electrical connector assembly for power utility transmission conductors includes a first conductive member having a tap conductor engagement surface adapted for interfacing with a tap conductor and a main conductor engagement surface adapted for interfacing with a main conductor. The first conductive member also includes a conductive member engagement surface adapted for interfacing with a second conductive member. The second conductive member is mechanically and electrically coupled to the first conductive member. The second conductive member has a tap conductor engagement surface adapted for interfacing with the tap conductor and a main conductor engagement surface adapted for interfacing with the main conductor. The second conductive member also includes a conductive member engagement surface adapted for interfacing with the conductive member engagement surface of the first conductive member. A lubricant is applied to at least one engagement surface of the first conductive member, and is applied to at least one engagement surface of the second conductive member.

10 Claims, 5 Drawing Sheets

U.S. PATENT DOCUMENTS 6,086,406 A 7/2000 Francois et al.
6,093,064 A * 7/2000 Callen et al. ..... 439/783
6,595,472 B1 7/2003 Pisczak
2007/0240301 A1 * 10/2007 Johnson et al. ..... 29/748

* cited by examiner

ELECTRICAL CONNECTOR WITH A WEDGE AND LUBRICANT

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. Hand tools, such as a torque wrench, are often utilized to tighten the bolt to clamp the connector pieces together. Because a high torque is required to tighten the bolt, the quality of the connection is dependent upon the relative strength and skill of the installer, and widely varying quality of connections may result. Additionally, the quality of the connection depends upon the amount of metal-to-metal engagement between the connector pieces and the conductors. When the engagement surfaces of the connector pieces and/or the conductors are oxidized, dirty or otherwise contaminated, a poor connection results. Poorly installed or improperly installed compression connectors can present reliability issues in power distribution systems.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors, however, tend to be more expensive than either bolt-on or compression connectors. Additionally, because of the high force needed to drive the wedge member into the C-shaped member, special application tooling using explosive cartridges packed with gunpowder has been developed to drive the wedge member into the C-shaped member. Such tooling is expensive and potentially dangerous to operate. Different connectors and tools are available for various sizes of conductors in the field.

AMPACT connectors are believed to provide superior performance over bolt-on and compression connectors. For example, the AMPACT connector results in a wiping contact surface that provides good electrical contact between the connectors and the conductors. Unlike conventional bolt-on and compression connectors, the AMPACT connector is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional power utility connectors.

BRIEF DESCRIPTION OF THE INVENTION

In one aspect, an electrical connector assembly is provided for power utility transmission conductors. The assembly includes a first conductive member having a tap conductor engagement surface adapted for interfacing with a tap conductor and a main conductor engagement surface adapted for interfacing with a main conductor. The first conductive member also includes a conductive member engagement surface adapted for interfacing with a second conductive member. The second conductive member is mechanically and electrically coupled to the first conductive member. The second conductive member has a tap conductor engagement surface adapted for interfacing with the tap conductor and a main conductor engagement surface adapted for interfacing with the main conductor. The second conductive member also includes a conductive member engagement surface adapted for interfacing with the conductive member engagement surface of the first conductive member. A lubricant is applied to at least one engagement surface of the first conductive member, and is applied to at least one engagement surface of the second conductive member. Optionally, the lubricant may be a wax-based lubricant and may be water soluble. The lubricant may be applied to the tap conductor and the main conductor. Each of the conductor engagement surfaces may define contact wiping surfaces.

In another aspect, an electrical connector assembly is provided for power utility transmission conductors. The assembly includes a first conductive member having a first wedge portion and a deflectable first channel portion extending from the first wedge portion. The first channel portion has a tap conductor engagement surface adapted for interfacing with a tap conductor and the first wedge portion has a main conductor engagement surface adapted for interfacing with a main conductor. The first wedge portion also includes a conductive member engagement surface adapted for interfacing with a second conductive member. The second conductive member has a second wedge portion and a deflectable second channel portion extending from the second wedge portion. The second wedge portion is configured to nest with the first wedge portion when the first and second conductive members are joined to one another. The second channel portion has a main conductor engagement surface adapted for interfacing with the main conductor and the second wedge portion has a tap conductor engagement surface adapted for interfacing with the tap conductor. The second wedge portion also includes a conductive member engagement surface adapted for interfacing with the conductive member engagement surface of the first wedge portion. A lubricant is applied to at least one engagement surface of the first conductive member, and is applied to at least one engagement surface of the second conductive member.

In yet another aspect, an electrical connector assembly is provided for power utility transmission conductors. The assembly includes a first conductive member including a generally C-shaped body extending between a leading edge and a trailing edge. The C-shaped body is formed by a first hook portion defining a tap conductor engagement surface adapted for interfacing with a tap conductor and a second hook portion defining a main conductor engagement surface adapted for interfacing with a main conductor. The assembly also includes a second conductive member having opposed first and second sides angled toward one another to define a wedge-shaped body. The first side includes a first channel and the second side includes a second channel. The first channel defines a tap conductor engagement surface adapted for interfacing with the tap conductor and the second channel defines a main conductor engagement surface adapted for interfacing with the main conductor. The second conductive member is positionable between the first and second hooks of the first conductive member to engage the tap and main conductors. A lubricant is applied to the tap and main conductor engagement surfaces of the first conductive member, and is applied to the tap and main conductor engagement surfaces of the second conductive member.

DETAILED DESCRIPTION OF THE INVENTION

Figure 1:
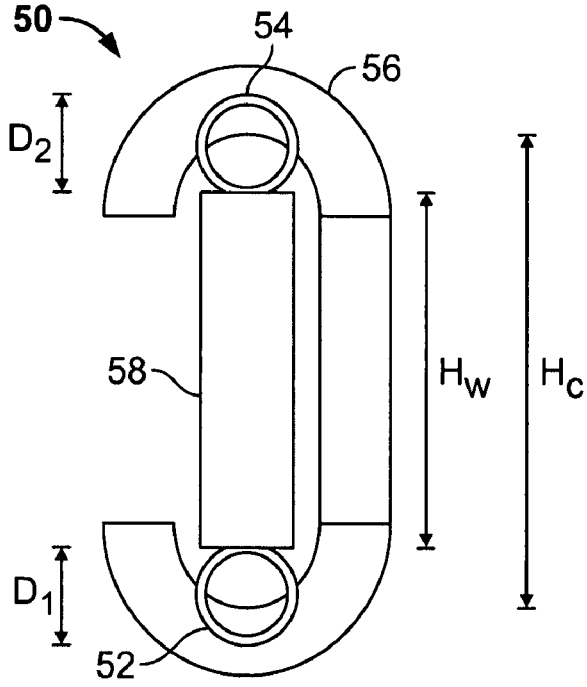
FIG. 1 (Prior Art)
FIG. 1 is a side elevational view of a known wedge connector assembly.
Figure 2:
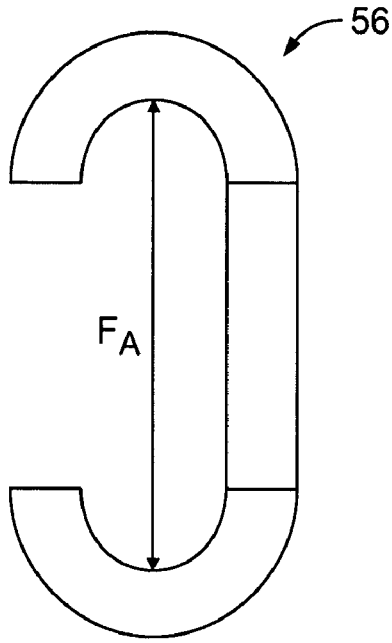
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. The tooling uses gunpowder packed cartridges to overcome the large mating force incurred during mating of the wedge member 58. The mating force must overcome the friction between the wedge member 58 and the conductors 52 and 54. Additionally, the wedge member 58 must be mated quickly to avoid unraveling of the conductors 52 and 54 as the applied force $F_A$ is applied to the conductors 52 and 54. Typically, the wedge member 58 is fully driven to a final position wherein the rear end of the wedge member 58 is substantially aligned with the rear edge of the spring member 56. The amount of deflection of the ends of the spring member 56 is determined by the size of the conductors 52 and 54. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_W+D_1+D_2-H_C \tag{1}$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
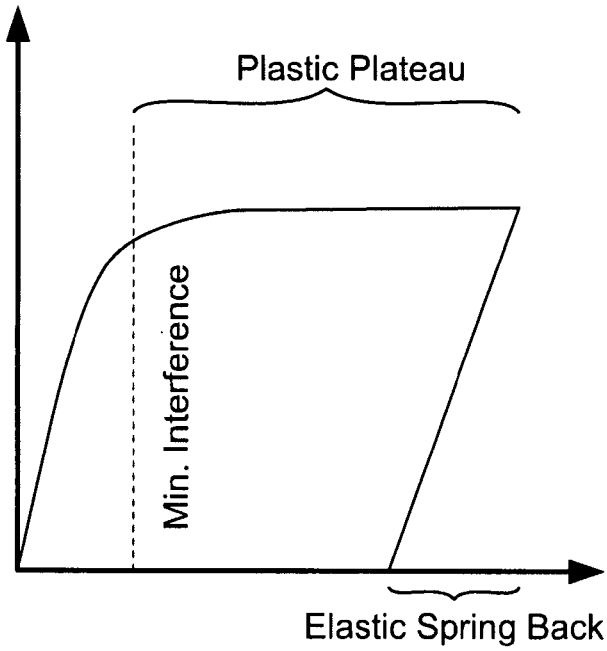
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. However, the need for a large inventory of differently sized spring members 56 and wedge members 58 renders the connector assembly 50 more expensive and less convenient than some user's desire.

Figure 4:
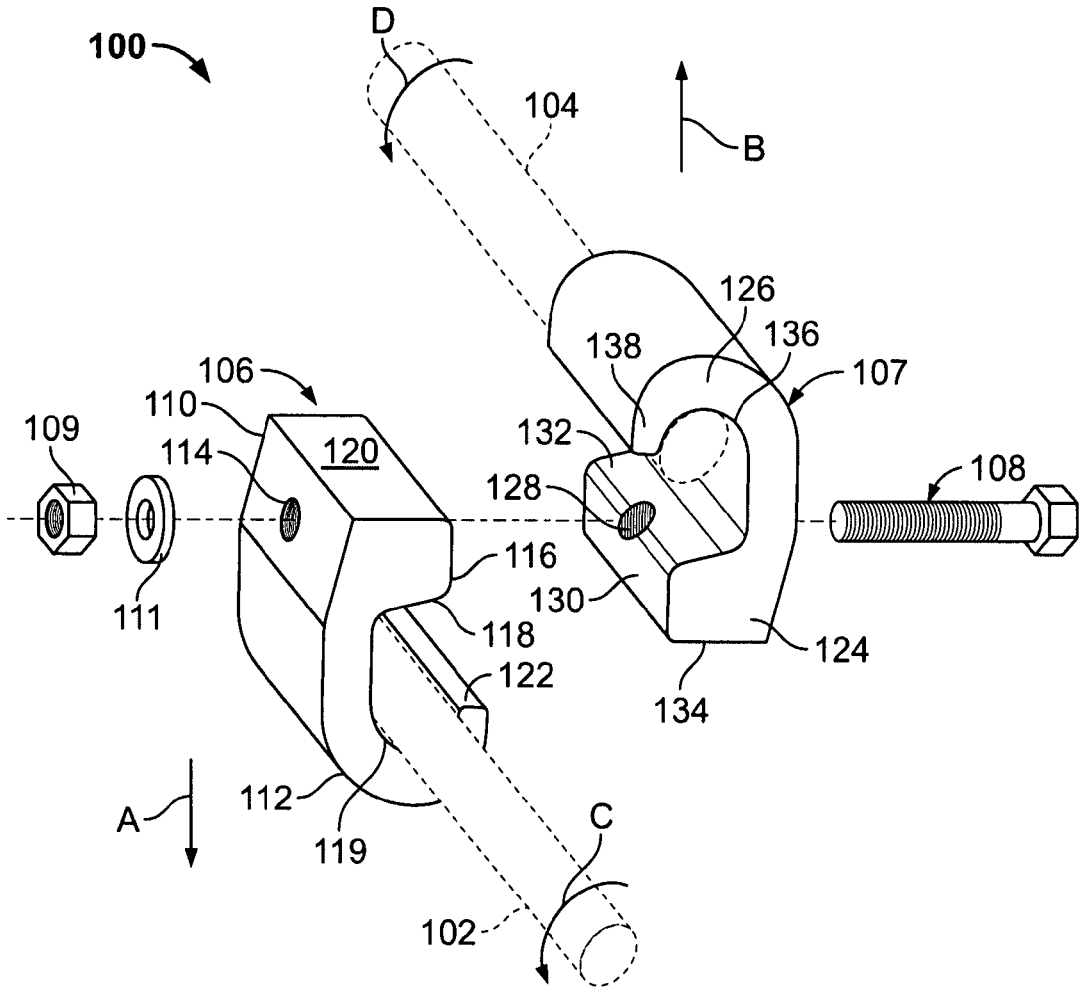
FIG. 4 is an exploded view of a connector assembly formed in accordance with an exemplary embodiment of the invention.

FIG. 4 is an exploded view of a connector assembly 100 formed in accordance with an exemplary embodiment. The connector assembly 100 is adapted for use as a tap connector for connecting a tap conductor 102 (shown in phantom in FIG. 4), to a main conductor 104 (also shown in FIG. 4) of a utility power distribution system. As explained in detail below, the connector assembly 100 provides superior performance and reliability and ease of installation relative to known connector systems.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gage or different wire gage in different applications and the connector assembly 100 is adapted to accommodate a range of wire gages for each of the tap conductor 102 and the main conductor 104.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gage, and a number of tap conductors 102 of the same or different wire gage. The connector assembly 100 may be used to provide tap connections between main conductors 104 and tap conductors 102 in the manner explained below.

As shown in FIG. 4, the connector assembly 100 includes a tap conductive member 106, a main conductive member 107, and a fastener 108 that couples the tap conductive member 106 and the main conductive member 107 to one another. In an exemplary embodiment, the fastener 108 is a threaded member inserted through the respective conductive members 106 and 107, and a nut 109 and lock washer 111 are provided to engage an end of the fastener 108 when the conductive members 106 and 107 are assembled. While specific fastener elements 108, 109 and 111 are illustrated in FIG. 4, it is understood that other known fasteners may alternatively be used if desired.

The tap conductive member 106 includes a wedge portion 110 and a channel portion 112 extending from the wedge portion 110. A fastener bore 114 is formed in and extends through the wedge portion 110, and the wedge portion 110 further includes an abutment face 116, a wiping contact surface 118 angled with respect to the abutment face 116, and a conductor contact surface 120 extending substantially perpendicular to the abutment face 116 and obliquely with respect to the wiping contact surface 118.

The channel portion 112 extends away from the wedge portion 110 and forms a channel or cradle 119 adapted to receive the tap conductor 102 at a spaced relation from the wedge portion 110. A distal end 122 of the channel portion 112 includes a radial bend that wraps around the tap conductor 102 for about 180 circumferential degrees in an exemplary embodiment, such that the distal end 122 faces toward the wedge portion 110, and the wedge portion 110 overhangs the channel or cradle 119. The channel portion 112 is reminiscent of a hook in one embodiment, and the wedge portion 110 and the channel portion 112 together resemble the shape of an inverted question mark. The tap conductive member 106 may be integrally formed and fabricated from extruded metal, together with the wedge and channel portions 110, 112 in a relatively straightforward and low cost manner.

The main conductive member 107 likewise includes a wedge portion 124 and a channel portion 126 extending from the wedge portion 124. A fastener bore 128 is formed in and extends through the wedge portion 124, and the wedge portion 124 further includes an abutment face 130, a wiping contact surface 132 angled with respect to the abutment face 130, and a conductor contact surface 134 extending substantially perpendicular to the abutment face 130 and obliquely with respect to the wiping contact surface 132. In one embodiment, an inner diameter of the fastener bore 128 is larger than an outer diameter of the fastener 108, thereby providing some relative freedom of movement of the fastener 108 with respect to the fastener bore 128 as the conductive members 106 and 107 are mated as explained below.

The channel portion 126 extends away from the wedge portion 124 and forms a channel or cradle 136 adapted to receive the main conductor 104 at a spaced relation from the wedge portion 124. A distal end 138 of the channel portion 126 includes a radial bend that wraps around the main conductor 104 for about 180 circumferential degrees in an exemplary embodiment, such that the distal end 138 faces toward the wedge portion 124, and the channel 136 overhangs the wedge portion 124. The channel portion 126 is reminiscent of a hook in one embodiment, and the wedge portion 124 and the channel portion 126 together resemble the shape of a question mark. The main conductive member 107 may be integrally formed and fabricated from extruded metal, together with the wedge and channel portions 124, 126 in a relatively straightforward and low cost manner.

The tap conductive member 106 and the main conductive member 107 are separately fabricated from one another or otherwise formed into discrete connector components and are assembled to one another as explained below. While one exemplary shape of the tap and main conductive members 106, 107 has been described herein, it is recognized that the conductive members 106, 107 may be alternatively shaped in other embodiments as desired.

In one embodiment, the wedge portions 110 and 124 of the respective tap and the main conductive members 106, 107 are substantially identically formed and share the same geometric profile and dimensions to facilitate interfitting of the wedge portions 110 and 124 in the manner explained below as the conductive members 106, 107 are mated. The channel portions 112, 126 of the conductive members 106 and 107, however, may be differently dimensioned as appropriate to be engaged to differently sized conductors 102, 104 while maintaining substantially the same shape of the conductive members 106, 107. Identical formation of the wedge portions 110 and 124 provides for mixing and matching of conductive members 106 and 107 for differently sized conductors 102, 104 while achieving a repeatable and reliable connecting interface via the wedge portions 110 and 124.

As shown in FIG. 4, the tap conductive member 106 and the main conductive member 107 are generally inverted relative to one another with the respective wedge portions 110 and 124 facing one another and the fastener bores 114, 128 aligned with one another to facilitate extension of the fastener 108 therethrough. The channel portion 112 of the tap conductive member 106 extends away from the wedge portion 110 in a first direction, indicated by the arrow A, and the channel portion 126 of the main conductive member 107 extends from the wedge portion 124 in a second direction, indicated by arrow B that is opposite to the direction of arrow A. Additionally, the channel portion 112 of the tap conductive member 106 extends around the tap conductor 102 in a circumferential direction indicated by the arrow C, while the channel portion 126 of the main conductive member 107 extends circumferentially around the main conductor 104 in the direction of arrow D that is opposite to arrow C.

Figure 5:
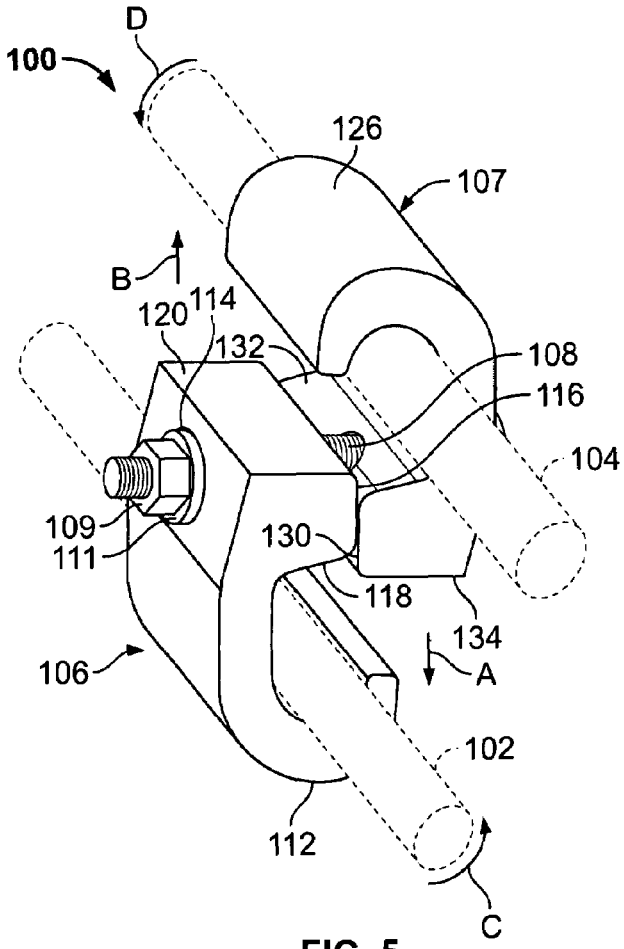
FIG. 5 is a perspective view of the assembly shown in FIG. 4 in an unmated position.

When the channel portions 112, 126 are hooked over the respective conductors 102, 104 and the when the conductive member 106, 107 are coupled together by the fastener elements 108, 109, 111, the abutment faces 116, 130 are aligned in an unmated condition, such as the condition shown in the perspective view illustrated in FIG. 5. The connector assembly 100 may be preassembled into the configuration shown in FIG. 5, and hooked over the conductors 102 and 104 in the directions of arrows C and D relatively easily.

During assembly, the abutment faces 116, 130 of the wedge portions 110, 124 are moved in sliding contact with one another, wherein the wedge portion 110 is moved in the direction of arrow B and the wedge portions 124 is moved in the direction of arrow A until the wiping contact surfaces 118, 132 are brought into engagement. The wedge portions 110, 124 may then be moved transversely into a nested or interfitted relationship with the wiping contact surfaces 118, 132 in sliding engagement to a final position, such as the position illustrated in FIG. 6. In the final position, the conductor contact surfaces 120, 134 engage the conductors 104, 102, respectively. Each of the conductive members 106, 107 include conductor engagement surfaces, as described in further detail below.

Figure 6:
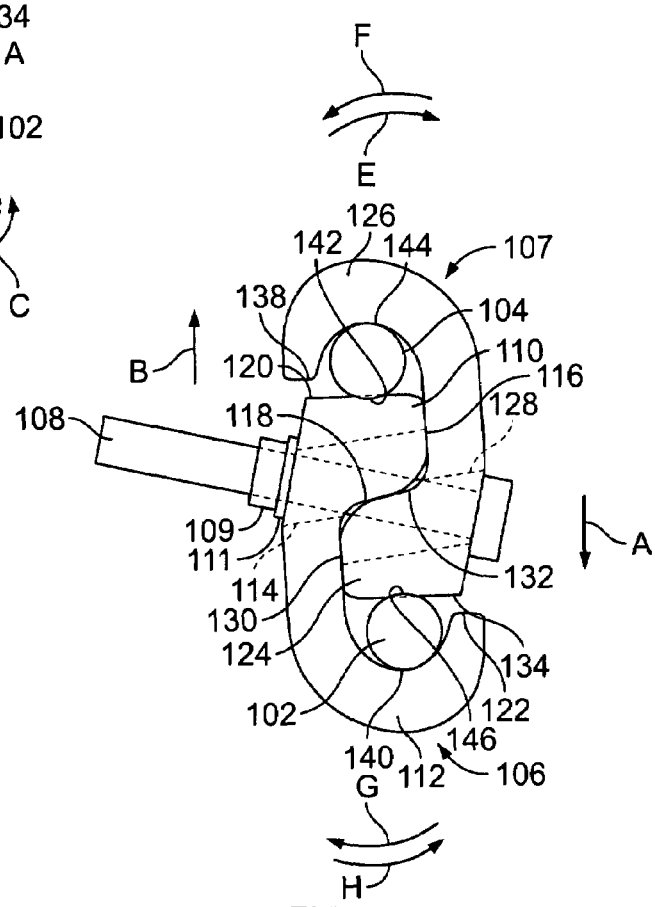
FIG. 6 is a side elevational view of the assembly shown in FIG. 4 in a fully closed or mated position.

As illustrated in FIG. 6, the channel portion 112 of the tap conductive member 106 includes a tap conductor engagement surface 140 along an inner surface thereof. The tap conductor 102 engages the tap conductor engagement surface 140. The wedge portion 110 of the tap conductive member 106 includes a main conductor engagement surface 142 along the conductor contact surface 120 thereof. The main conductor 104 engages the main conductor engagement surface 142.

Likewise, the channel portion 126 of the main conductive member 107 includes a main conductor engagement surface 144 along an inner surface thereof. The main conductor 104 engages the main conductor engagement surface 144. The wedge portion 124 of the main conductive member 107 includes a tap conductor engagement surface 146 along the conductor contact surface 134 thereof. The tap conductor 102 engages the tap conductor engagement surface 146.

In an exemplary embodiment, a lubricant is applied to the conductive members 106, 107 and/or the conductors 102, 104 prior to assembly to ease assembly of the connector assembly 100. The lubricant may be a wax based lubricant. Optionally, the lubricant may be water soluble, such that the lubricant is mixed in water and applied to the conductive members 106, 107 and/or the conductors 102, 104 in liquid form. When the water evaporates, the lubricant remains as a thin, solid film covering the conductive members 106, 107 and/or the conductors 102, 104. In alternative embodiments, other types of lubricants may be used, such as liquid-based lubricants, petroleum-based lubricants, grease lubricants, powder-based lubricants, graphite, polytetrafluoroethylene, molybdenum disulfide, and the like.

The lubricant may be applied to the conductor engagement surfaces 140, 142, 144, 146 to reduce the friction between the conductive members 106, 107 and the conductors 102, 104 during assembly. The lubricant may be applied to the conductors 102, 104 to reduce the friction between the conductive members 106, 107 and the conductors 102, 104 during assembly. The lubricant may be applied to the conductive members 106, 107 to reduce the friction between the conductive members 106, 107 and the conductors 102, 104 during assembly. For example, the lubricant may be applied to the abutment surfaces 116, 130 and/or the wiping contact surfaces 118, 132 to reduce the friction between the conductive members 106, 107 and the conductors 102, 104 during assembly. The lubricant may also be applied to reduce wear or corrosion of the conductive members 106, 107 and the conductors 102, 104. Optionally, the lubricant may also be applied to the fastener 108, nut 109 and/or fastener bores 114, 128 to ease tightening of the fastener 108. The lubricant may also be applied to the outer surface of the conductive members 106, 107, such as at the interface of the head of the fastener 108 and the conductive member 107 where the fastener 108 rotatably engages the conductive member 107. Optionally, an additive may be added to the lubricant to deliver reduced friction and wear, increased viscosity, improved viscosity index, resistance to corrosion and oxidation, aging or contamination, and the like.

FIG. 6 illustrates the connector assembly 100 in a fully mated position with the nut 109 tightened to the fastener 108. As the conductive members 106, 107 are mated, the wiping contact surfaces 118, 132 slidably engage one another and provide a wiping contact interface that ensures adequate electrically connectivity. The lubricant reduces the friction between the wiping contact surfaces 118, 132 to reduce the mating force between the conductive members 106, 107. The angled wiping contact surfaces 118, 132 provide a ramped contact interface that displaces the conductor contact surfaces 120, 134 in opposite directions, indicated by arrows A and B in FIG. 6, as the wiping contact surfaces 118, 132 are engaged. In addition, the conductor contact surfaces 120, 134 provide wiping contact interfaces with the conductors 102 and 104 as the connector assembly 100 is installed. The lubricant reduces the friction between the conductor contact surfaces 120, 134 and the conductors 104, 102 to reduce the mating force between the conductive members 106, 107. As such, the torque applied to the fastener to mate the conductive members 106, 107 may be reduced.

Movement of the conductor contact surfaces 120, 134 in the opposite directions of arrows A and B clamps the conductors 102 and 104 between the wedge portions 110 and 124, and the opposing channel portions 112, 126. The distal ends 122, 138 of the channel portions 112, 126 are brought adjacent to the wedge portions 110, 124 to the mated position, thereby substantially enclosing portions of the conductors 102, 104 within the connector assembly 100. Eventually, the abutment faces 116, 130 of the wedge portions 110, 124 contact the channel portions 126, 112 of the opposing conductive members 107 and 106, and the connector assembly 100 is fully mated. In such a position, the wedge portions 110, 124 are nested or mated with one another in an interfitting relationship with the wiping contact surfaces 118 and 132, the abutment faces 116 and 130, and the channel portions 112 and 126 providing multiple points of mechanical and electrical contact to ensure electrical connectivity between the conductive members 106 and 107.

In the fully mated position, the main conductor 104 is captured between the channel portion 126 of the main conductive member 107 and the conductor contact surface 120 of the tap conductive member wedge portion 110. Likewise, the tap conductor 102 is captured between the channel portion 112 of the tap conductive member 106 and the conductor contact surface 134 of the main conductive member wedge portion 124. As the wedge portion 110 engages the tap conductive member 106 and clamps the main conductor 104 against the channel portion 126 of the main conductive member 107 the channel portion 126 is deflected in the direction of Arrow E. The channel portion 126 is elastically and plastically deflected in a radial direction indicated by arrow E, resulting in a spring back force in the direction of Arrow F, opposite to the direction of arrow E to provide a clamping force on the conductor. A large contact force, on the order of about 4000 lbs is provided in an exemplary embodiment, and the clamping force ensures adequate electrical connectivity between the main conductor 104 and the connector assembly 100. Additionally, elastic spring back of the channel portion 126 provides some tolerance for deformation or compressibility of the main conductor 104 over time, because the channel portion 126 may effectively return in the direction of arrow F if the main conductor 104 deforms due to compression forces. Actual clamping forces may be lessened in such a condition, but not to such an amount as to compromise the integrity of the electrical connection.

Likewise, the wedge portion 124 of the main conductive member 107 clamps the tap conductor 102 against the channel portion 112 of tap conductive member 106 and the channel portion 112 is deflected in the direction of arrow G. The channel portion 112 is elastically and plastically deflected in a radial direction indicated by arrow G, resulting in a spring back force in the direction of Arrow H opposite to the direction of arrow G. A large contact force, on the order of about 4000 lbs is provided in an exemplary embodiment, and the clamping force ensures adequate electrical connectivity between the tap conductor 102 and the connector assembly 100. Additionally, elastic spring back of the channel portion 112 provides some tolerance for deformation or compressibility of the tap conductor 102 over time, because the channel portion 112 may simply return in the direction of arrow H if the tap conductor 102 deforms due to compression forces. Actual clamping forces may be lessened in such a condition, but not to such an amount as to compromise the integrity of the electrical connection.

When fully mated, the abutment faces 116 and 130 engage the channel portions 126 and 112 to form a displacement stop that defines and limits a final displacement relation between the tap and main conductive members 106 and 107. The displacement stop defines a final mating position between the tap and main conductive members 106 and 107 independent of an amount of force induced upon the main and tap conductors 104 and 102 by the main and tap conductive members 107 and 106.

Optionally, the displacement stop may be created from a stand off provided on one or both of the main and tap conductive members 107 and 106. For example, the stand off may be positioned proximate the fastener bore 128 and extend outward therefrom. Alternatively, the stand off may be created as mating notches provided in the wiping contact surfaces 118 and 132, where the notches engage one another to limit a range of travel of the main and tap conductive members 107 and 106 toward one another.

Unlike known bolt connectors, torque requirements for tightening of the fastener 108 are not required to satisfactorily install the connector assembly 100. Additionally, the lubricant reduces the torque requirements by reducing the friction between the conductive members 106, 107, by reducing the friction between the conductive members 106, 107 and the conductors 102, 104, and/or by reducing the friction between the fastener 108 and the nut 109. When the abutment faces 116, 130 of the wedge portions 110, 124 contact the channel portions 126 and 112, the connector assembly 100 is fully mated. By virtue of the fastener elements 108 and 109 and the combined wedge action of the wedge portions 110, 124 to deflect the channel portions 112 and 126, the connector assembly 100 may be installed with hand tools, and specialized tooling, such as the explosive cartridge tooling of the AMPACT Connector system is avoided.

The displacement stop allows the nut 109 and fastener 108 to be continuously tightened until the abutment faces 116 and 130 fully seat against the channel portions 126 and 112, independent of, and without regard for, any normal forces on the tap and main conductors 102 and 104. The contact forces are created by interference between the channel portions 126, 112, and wedge portions 110, 124, and tap and main conductors 102 and 104. Repeatable and reliable performance may be provided via elastic and plastic deformation of the conductive members, while eliminating a need for special tooling to assemble the connector. The assembly 100 is fully mated when the main and tap conductive members 106 and 107 are joined to a predetermined position or relative displacement. In the fully mated condition, the interference between the conductors 102 and 104 and the connector assembly 100 produces a contact force adequate to provide a good electrical connection.

It is recognized that effective assembly of the connector assembly 100 is dependent upon the geometry of the wedge portions, dimensions of the channel portions, torque requirement of the fastener elements 108, 109 and size of the conductors used with the connector assembly 100. Additionally, the torque needed to tighten the fastener elements 108, 109 may vary, such as with strategic selections of the lubricant, the placement of the lubricant, the angles for the wiping contact surfaces 118, 130, the radius and thickness of the curved distal ends 122 and 138 of the conductive members, and the like.

Because of the deflectable channel portions 112, 126 in discrete connector components, the conductive members 106 and 107 may accommodate a greater range of conductor sizes or gauges in comparison to conventional wedge connectors. Additionally, even if several versions of the conductive members 106 and 107 are provided for installation to different conductor wire sizes or gauges, the assembly 100 requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems.

It is therefore believed that the connector assembly 100 provides the performance of conventional wedge connector systems in a lower cost connector assembly that does not require specialized tooling and a large inventory of parts to meet installation needs. Using low cost extrusion fabrication processes and known fasteners, the connector assembly 100 may be provided at low cost. Using the lubricant on select locations of the conductors 102, 104, the conductive members 106, 107, and/or fastener elements 108, 109 may provide reduced mating forces and ease mating of the conductive members 106, 107, which may provide increased repeatability and reliability as the connector assembly 100 is installed and used. The combination wedge action of the conductive members 106 and 107 provides a reliable and consistent clamping force on the conductors 102 and 104 and is less subject to variability of clamping force when installed than either of known bolt-on or compression-type connector systems.

Figure 7:
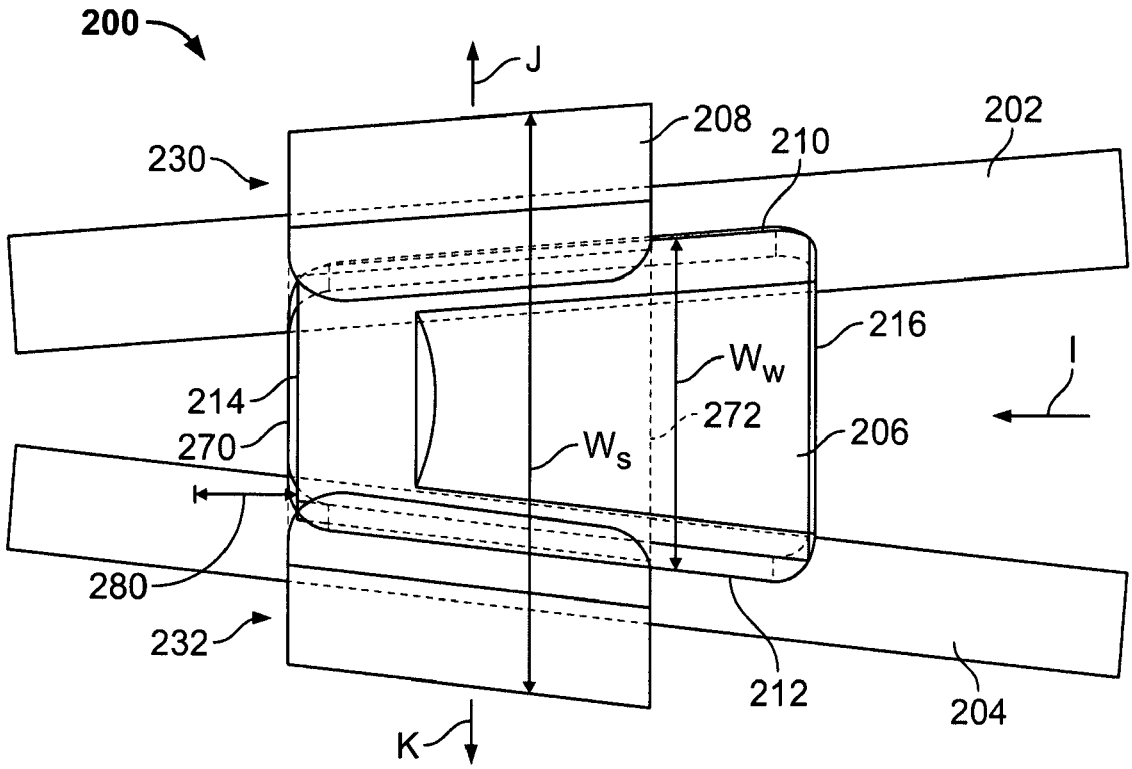
FIG. 7 is a top view of an alternative connector assembly formed in accordance with an alternative embodiment.
Figure 8:
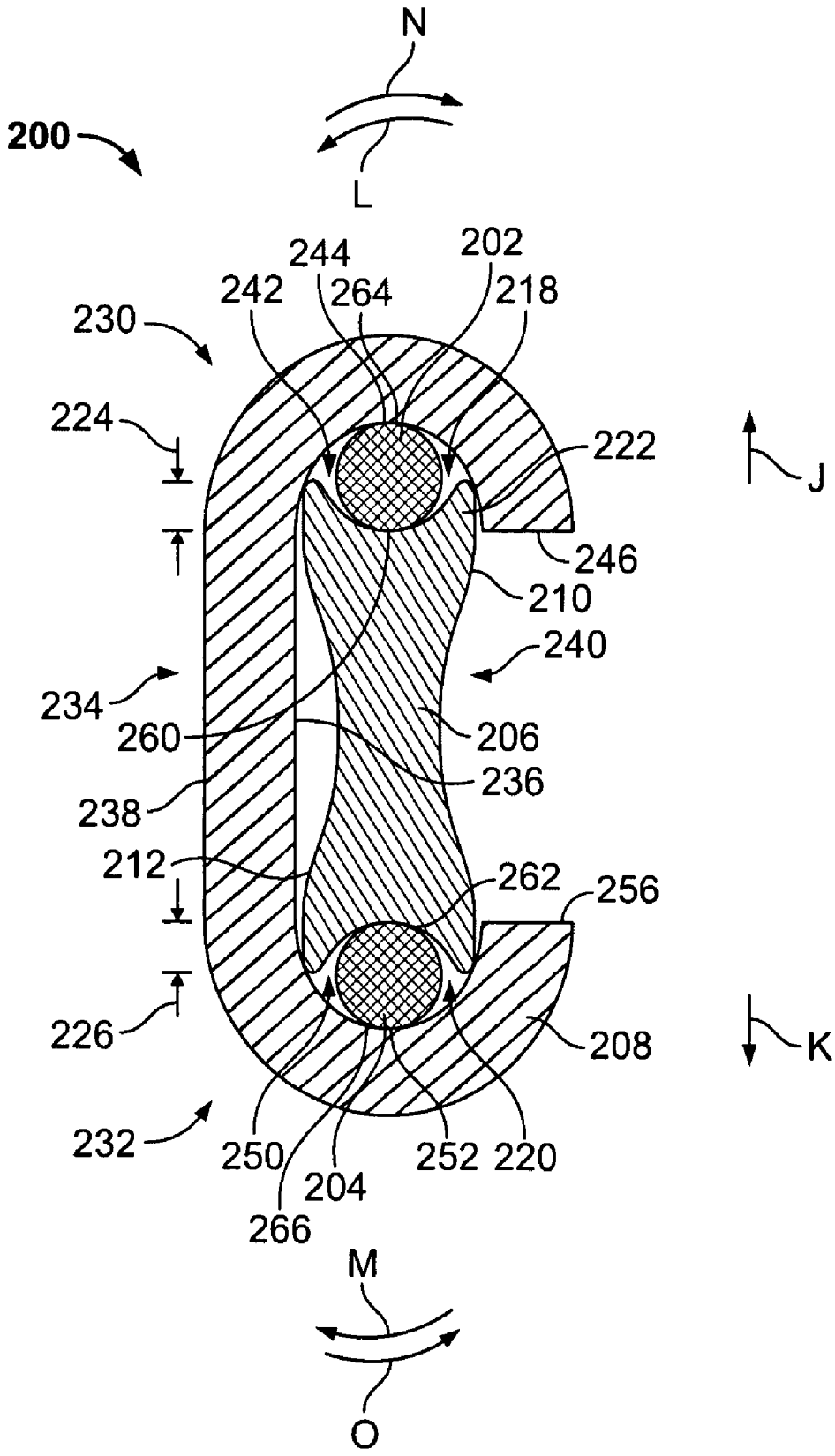
FIG. 8 is a cross-sectional view of the connector assembly shown in FIG. 7.

FIG. 7 is a top view of an alternative connector assembly 200 adapted for use as a tap connector for connecting a tap conductor 202 to a main conductor 204 of a utility power distribution system. FIG. 8 is a cross-sectional view of the connector assembly 200. The connector assembly 200 includes a first conductive member 206, also referred to hereinafter as a wedge member 206, and a second conductive member 208, also referred to hereinafter as a C-shaped spring member 208. The conductive members 206, 208 cooperate to couple the tap conductor 202 and the main conductor 204 to one another.

In an exemplary embodiment, the wedge member 206 includes first and second sides 210 and 212, respectively, which extend between a leading end 214 and a trailing end 216. The first and second sides 210 and 212 are tapered from the trailing end 216 to the leading end 214, such that a cross-sectional width $W_w$ between the first and second sides 210 and 212 is greater proximate the trailing end 216 than the leading end 214. The tapered first and second sides 210 and 212 form a wedge shaped body for the wedge member 206.

As best illustrated in FIG. 8, each of the first and second sides 210 and 212 include concave indentations that represent conductor receiving channels, identified generally at 218 and 220, respectively. The channels 218, 220 have a predetermined radius that cups the conductors 202, 204 to position the conductors 202, 204 with respect to the spring member 208. The formation and geometry of the wedge member 206 provides for interfacing with differently sized conductors 202, 204 while achieving a repeatable and reliable interconnection of the wedge member 206 and the conductors 202, 204.

In an exemplary embodiment, lips 222 of the channels 218, 220 are spaced apart to accommodate differently sized conductors 202, 204, and the channels 218, 220 have depths 224 and 226, respectively, for accommodating differently sized conductors 202, 204. In one embodiment, the channels 218 and 220 are substantially identically formed and share the same geometric profile and dimensions to facilitate capturing of the conductors 202 and 204 between the wedge member 206 and the spring member 208 during mating. The channels 218 and 220, however, may be differently dimensioned as appropriate to be engaged to differently sized conductors 202, 204 while maintaining substantially the same shape of the wedge member 206. For example, the depths 224 and 226 may be different such that the one of the channels 218 or 220 may accommodate larger sized conductors and the other of the channels 218 or 220 may accommodate smaller sized conductors. In an exemplary embodiment, the depths 224 and 226 are selected to be less than one half of the diameter of the conductors 202 and 204. As such, the sides 210 and 212 do not interfere with the spring member 208, thus the force of the spring member 208 is applied entirely to the conductors 202 and 204. Optionally, the radius and/or depths 224, 226 of the channels 218, 220 may vary along the length of the channels 218, 220.

Still referring to FIG. 8, the C-shaped spring member 208 includes a first hook portion 230, a second hook portion 232, and a central portion 234 extending therebetween. The spring member 208 further includes an inner surface 236 and an outer surface 238. The spring member 208 forms a chamber 240 defined by the inner surface 236 of the spring member 208. The conductors 202, 204 and the wedge member 206 are received in the chamber 240 during assembly of the connector assembly 200.

In an exemplary embodiment, the first hook portion 230 forms a first contact receiving portion or cradle 242 positioned at an end of the chamber 240. The cradle 242 is adapted to receive the tap conductor 202 at an apex 244 of the cradle 242. A distal end 246 of the first hook portion 230 includes a radial bend that wraps around the tap conductor 202 for about 180 circumferential degrees in an exemplary embodiment, such that the distal end 246 faces toward the second hook portion 232.

Similarly, the second hook portion 232 forms a second contact receiving portion or cradle 250 positioned at an opposing end of the chamber 240. The cradle 242 is adapted to receive the main conductor 204 at an apex 252 of the cradle 250. A distal end 256 of the second hook portion 232 includes a radial bend that wraps around the main conductor 204 for about 180 circumferential degrees in an exemplary embodiment, such that the distal end 256 faces toward the first hook portion 230. The spring member 208 may be integrally formed and fabricated from extruded metal in a relatively straightforward and low cost manner.

Each of the conductive members 206, 208 include conductor engagement surfaces that engage the conductors 202, 204. The first conductor receiving channel 218 of the wedge member 206 includes a tap conductor engagement surface 260 and the second conductor receiving channel 220 includes a main conductor engagement surface 262. The tap conductor 202 engages the tap conductor engagement surface 260 and the main conductor 204 engages the main conductor engagement surface 262.

Likewise, the first hook portion 230 of the C-shaped spring member 208 includes a tap conductor engagement surface 264 along an inner surface thereof and the second hook portions 232 includes a main conductor engagement surface 266 along an inner surface thereof. The tap conductor 202 engages the tap conductor engagement surface 264 and the main conductor 204 engages the main conductor engagement surface 266.

In an exemplary embodiment, a lubricant is applied to the wedge and spring members 206, 208 and/or the conductors 202, 204 prior to assembly to ease assembly of the connector assembly 200. The lubricant may be substantially similar to the lubricant described above. The lubricant may be applied to the conductor engagement surfaces 260, 262, 264, 266 to reduce the friction between the wedge and spring members 206, 208 and the conductors 202, 204 during assembly. The lubricant may be applied to the conductors 202, 204 in addition to, or in the alternative to, the wedge and spring members 206, 208. The lubricant may be applied to other portions of the wedge and spring members 206, 208, such as portions of the wedge and spring members 206, 208 that engage one another, to reduce the friction between the conductive members 206, 208. The lubricant may be used to reduce the mating force of the spring member 208 with respect to the wedge member 206.

Returning to FIG. 7, the spring member 208 further includes a leading edge 270 and a trailing edge 272. The first and second hook portions 230 and 232 are tapered from the trailing edge 272 to the leading edge 270, such that a cross-sectional width $W_s$ between the first and second hook portions 230 and 232 is greater proximate the trailing edge 272 than the leading edge 270.

The wedge member 206 and the spring member 208 are separately fabricated from one another or otherwise formed into discrete connector components and are assembled to one another as explained below. While one exemplary shape of the wedge and spring members 206, 208 has been described herein, it is recognized that the members 206, 208 may be alternatively shaped in other embodiments as desired.

During assembly of the connector assembly 200, the lubricant is applied to the wedge and spring members 206, 208 and/or the conductors 202, 204. The tap conductor 202 and the main conductor 204 are then positioned within the chamber 240 and placed against the inner surface 236 of the first and second hook portions 230 and 232, respectively. The wedge member 206 is then positioned between the conductors 202, 204 such that the conductors 202, 204 are received within the channels 218, 220.

The wedge member 206 is moved forward, in the direction of arrow I shown in FIG. 7, to an initial position, such as the position illustrated in FIG. 7. In the initial position, the conductors 202, 204 are held tightly between the wedge member 206 and the spring member 208 but the spring member 208 remains largely un-deformed. In the initial position, no gaps or spaces exist between the conductors 202, 204 and either of the wedge member 206 or the spring member 208. Optionally, the hook portions 230, 232 of the spring member 206 may be partially deflected outward, in the direction of arrows J and K, in the initial position. In an exemplary embodiment, the wedge member 206 is pressed hand-tight within the spring member 208 by the user such that the spring member 208 is minimally deflected. The lubricant allows the user to more easily position the wedge member 206 in the initial position. By pressing hand-tight, a user is able to exert an applied force $F_a$ to the spring member 208 on the order of 100 lbs of clamping force against the conductors 202, 204.

During mating, the wedge member 206 is pressed forward into the spring member 208 by a tool in the direction of arrow I to a final, mated position. The lubricant reduces the friction between the wedge and spring members 206, 208 and the conductors 202, 204 such that the wedge member 206 may be pressed forward more easily and with a lower application force to the wedge member 206. As the wedge member 206 is pressed into the spring member 208, the hook portion 230 is deflected outward in the direction of arrow J, and the hook portion 232 is deflected outward in the direction of arrow K. The wedge member 206 is pressed into the spring member 208 during the mating process for a distance 280 to a final position. Optionally, the distance 280 may be the same for each assembly of the connector assembly 200 and for each conductor 202, 204 size. Because the distance 280 directly corresponds to the deflection of the spring member 208, repeatably moving the same distance 280 during mating corresponds to repeatably having the same amount of deflection of the spring member 208, irrespective of the conductor size. The distance 280 is dictated by the tapered angle of the wedge member 208 and the spring member 206 and the required interference. As a result, the connector assembly 200 may provide increased repeatability and reliability as the connector assembly 200 is installed and used.

Turning to FIG. 8, in the mated, final position, the tap conductor 202 is captured between the channel 218 of the wedge member 206 and the inner surface 236 of the first hook portion 230. Likewise, the main conductor 204 is captured between the channel 220 of the wedge member 206 and the inner surface 238 of the second hook portion 232. As the wedge member 206 is pressed into the chamber 240 of the spring member 208, the hook portions 230, 232 are deflected in the direction of arrows L and M, respectively. The spring member 208 is elastically and plastically deflected resulting in a spring back force in the direction of arrows N and O, opposite to the directions of arrows L and M to provide a clamping force on the conductors 202, 204. A large application force, on the order of about 4000 lbs of clamping force is provided in an exemplary embodiment, and the clamping force ensures adequate electrical contact force and connectivity between the connector assembly 200 and the conductors 202, 204. Additionally, elastic deflection of the spring member 208 provides some tolerance for deformation or compressibility of the conductors 202, 204 over time, because the hook portions 230, 232 may effectively return in the directions of arrows N and O if the conductors 202, 204 deform due to compression forces. Actual clamping forces may be lessened in such a condition, but not to such an amount as to compromise the integrity of the electrical connection.

It is recognized that effective clamping force on the conductors 202, 204 is dependent upon the geometry of the wedge and spring members 206, 208, and dimensions of the channels. Additionally, the mating force needed to press the wedge member 206 into the spring member 208 may be varied, such as with strategic selections of the lubricant, the placement of the lubricant, the angles of the channels, and the like. Additionally, with the use of the lubricant to reduce the mating force, the connector assembly 200 may be capable of being assembled without the use of specialized tooling using explosive cartridges packed with gunpowder. Rather, a more conventional, less expensive, and less dangerous tool may be used to mate the wedge and spring members 206, 208, such as a wrench, pliers, an electrically or pneumatically driven clamp, and the like. Using the lubricant on select locations of the conductors 202, 204, and/or the wedge and spring members 206, 208 may provide increased repeatability and reliability as the connector assembly 200 is installed and used. The wedge action of the wedge and spring members 206 and 208 provides a reliable and consistent clamping force on the conductors 202 and 204 and is less subject to variability of clamping force when installed than either of known bolt-on or compression-type connector systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first,""second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector assembly for power utility transmission conductors, the assembly comprising:

a first conductive member having a first wedge portion and a deflectable first channel portion extending from the first wedge portion, the first channel portion having a tap conductor engagement surface adapted for interfacing with a tap conductor at a spaced location from the first wedge portion, and the first wedge portion having a main conductor engagement surface adapted for interfacing with a main conductor and a conductive member engagement surface adapted for interfacing with a second conductive member;

the second conductive member having a second wedge portion and a deflectable second channel portion extending from the second wedge portion, wherein the second wedge portion is configured to nest with the first wedge portion when the first and second conductive members are joined to one another, the second channel portion having a main conductor engagement surface adapted for interfacing with the main conductor at a spaced location from the second wedge portion, and the second wedge portion having a tap conductor engagement surface adapted for interfacing with the tap conductor and a conductive member engagement surface adapted for interfacing with the conductive member engagement surface of the first conductive member;

wherein the tap conductor is captured between the first channel portion and the second wedge portion, and further wherein the main conductor is captured between the second channel portion and the first wedge portion when the first and second conductive members are joined to one another; and a lubricant applied to at least one engagement surface of at least one of the first and second conductive members.

2. The assembly of claim 1, wherein the lubricant is a wax-based lubricant.

3. The assembly of claim 1, wherein each of the engagement surfaces define contact wiping surfaces.

4. The assembly of claim 1, wherein the first and second wedge portions are substantially identically formed with one another, the conductive member engagement surfaces define wiping contact surfaces that are in abutting contact with one another, wherein the lubricant is applied to the wiping contact surfaces.

5. The assembly of claim 1, wherein the first and second wedge portions each include an abutment face, the conductive member engagement surfaces are angled with respect to the abutment face, and the tap and main conductor contact surfaces of the wedge portions extend substantially perpendicular to the corresponding abutment faces, the main and tap conductors are configured to be captured between respective channel portions and conductor contact surfaces of the wedge portions.

6. The assembly of claim 1, wherein the first channel portion extends circumferentially around the tap conductor in a first direction, and the second channel portion extends circumferentially around the main conductor in a second direction, the second direction being opposite to the first direction.

7. The assembly of claim 1, wherein the lubricant is water soluble.

8. The assembly of claim 1, wherein the lubricant is configured to be applied to the tap conductor and the main conductor.

9. The assembly of claim 1, further comprising a fastener joining the first and second conductive members, wherein the lubricant is applied to the fastener.

10. The assembly of claim 9, wherein the first and second conductive members each include fastener engagement surfaces adapted for interfacing with the fastener, wherein the lubricant is applied to the fastener engagement surface of at least one of the first and second conductive members.

* * * * *